US008093966B2

(12) United States Patent
Mortun

(10) Patent No.: US 8,093,966 B2
(45) Date of Patent: Jan. 10, 2012

(54) IMPACT SOLENOID ASSEMBLY FOR AN ELECTRICAL RECEPTACLE

(75) Inventor: Sorin I. Mortun, Irvington, NY (US)

(73) Assignee: Hubbell Incorporated, Shelton, CT (US)

( * ) Notice: Subject to any disclaimer, the term of this patent is extended or adjusted under 35 U.S.C. 154(b) by 471 days.

(21) Appl. No.: 12/184,220

(22) Filed: Jul. 31, 2008

(65) Prior Publication Data

US 2010/0026426 A1 Feb. 4, 2010

(51) Int. Cl.
*H01H 73/00* (2006.01)

(52) U.S. Cl. ..... 335/18; 335/167; 335/265

(58) Field of Classification Search ..... 335/18, 335/202, 220–229, 232, 242, 251, 259, 265, 335/166–179

See application file for complete search history.

(56) References Cited

U.S. PATENT DOCUMENTS

| | | | | |
|---|---|---|---|---|
| 2,875,294 | A * | 2/1959 | Schleicher | 335/175 |
| 3,914,720 | A | 10/1975 | Drubig | |
| 4,010,432 | A * | 3/1977 | Klein et al. | 335/18 |
| 4,135,134 | A * | 1/1979 | Ebel et al. | 335/20 |
| 4,646,043 | A | 2/1987 | Hoffman | |
| 4,802,052 | A | 1/1989 | Brant | |
| 5,223,810 | A | 6/1993 | Van Haaren | |
| 5,933,063 | A | 8/1999 | Keung | |
| 6,434,822 | B1 | 8/2002 | Perry | |
| 6,580,344 | B2 | 6/2003 | Li | |
| 6,731,212 | B2 | 5/2004 | Hirose | |
| 6,788,173 | B2 | 9/2004 | Germain | |
| 6,805,331 | B2 | 10/2004 | Burrola | |
| 6,938,875 | B2 | 9/2005 | Ichinose | |
| 7,031,125 | B2 | 4/2006 | Germain | |
| 7,131,632 | B2 | 11/2006 | Kish, Jr. | |
| 2005/0140476 | A1 | 6/2005 | Gao | |
| 2006/0044086 | A1 | 3/2006 | Wang | |

* cited by examiner

*Primary Examiner* — Bernard Rojas
(74) *Attorney, Agent, or Firm* — Marcus R. Mickney; Mark S. Bicks; Alfred N. Goodman

(57) ABSTRACT

An impact solenoid assembly for an electrical receptacle includes an armature having first and second ends. A resilient member is disposed between a latch and the second end of the armature. The resilient member spaces the armature from the latch. A plunger abuts the second end of the armature. When the solenoid is activated, the solenoid drives the armature toward the plunger, thereby creating momentum in the armature prior to striking the plunger. This increases the force with which the armature and plunger strike the latch.

19 Claims, 5 Drawing Sheets

IMPACT SOLENOID ASSEMBLY FOR AN ELECTRICAL RECEPTACLE

FIELD OF THE INVENTION

The present invention relates to an impact solenoid assembly for an electrical receptacle. More particularly, the present invention relates to a resilient member that spaces an armature from a latch of an impact solenoid assembly. Still more particularly, the present invention relates to a resilient member passing through a plunger to space an armature from a latch of an impact solenoid assembly, thereby increasing the momentum of the armature when activated and providing an impact solenoid assembly installable in any orientation.

BACKGROUND OF THE INVENTION

Fault interrupting devices are designed to trip in response to the detection of a fault condition at an AC load. The fault condition can result when a person comes into contact with the line side of the AC load and an earth ground, a situation which can result in serious injury. A ground fault circuit interrupter (GFCI) detects this condition by using a sense transformer to detect an imbalance between the currents flowing in the line and neutral conductors of the AC supply, as will occur when some of the current on the line side is being diverted to ground. When such an imbalance is detected, a relay or circuit breaker within the GFCI device is immediately tripped to an open condition, thereby removing all power from the load.

Many types of GFCI devices are capable of being tripped not only by contact between the line side of the AC load and ground, but also by a connection between the neutral side of the AC load and ground. The latter type of connection, which may result from a defective load or from improper wiring, is potentially dangerous because it can prevent a conventional GFCI device from tripping at the required threshold level of differential current when a line-to-ground fault occurs.

A ground fault is not the only class of potentially dangerous abnormal operating conditions. Another type of undesirable operating condition occurs when an electrical spark jumps between two conductors or from one conductor to ground, which is also known as an arcing path. This spark represents an electrical discharge through the air and is objectionable because heat is produced as an unintentional by-product of the arcing. Such arcing faults are a leading cause of electrical fires.

Arcing faults can occur in the same places that ground faults occur; in fact, a ground fault would be called an arcing fault if it resulted in an electrical discharge, or spark, across an air gap. A device known as an arc fault circuit interrupter (AFCI) can prevent many classes of arcing faults. Both GFCIs and AFCIs are referred to as fault protection devices.

Solenoid assemblies in existing fault protection devices use a solenoid to drive an armature against a plunger to release a latch. The armature abuts the plunger such that the solenoid must drive both the armature and the plunger toward the latch. Thus, when the solenoid is activated, a large amount of activating force is required to drive both the armature and the plunger toward the latch. Furthermore, the activating force must overcome frictional forces.

Thus, there is a continuing need to provide an improved impact solenoid assembly for an electrical receptacle.

SUMMARY OF THE INVENTION

Accordingly, it is a primary objective of the present invention to provide an improved impact solenoid assembly for an electrical receptacle.

A further objective of the present invention is to provide an improved impact solenoid assembly that spaces an armature from a plunger to increase the impact force against a latch.

A still further objective of the present invention is to provide a resilient member for spacing the armature from the latch.

The foregoing objectives are basically attained by an electrical receptacle having an impact solenoid assembly. An armature has first and second ends. A resilient member is disposed between a latch and the second end of the armature. The resilient member spaces the armature from the latch. A plunger is disposed between the latch and the second end of the armature.

The foregoing objectives are also basically attained by an impact solenoid assembly for an electrical receptacle. A latch has first and second surfaces. An armature has first and second ends. A plunger is disposed between the latch and the second end of the armature. The plunger has a passageway extending from a first end to a second end of the plunger. A first spring is disposed between the first surface of the latch and the second end of the armature and passes through the passageway in the plunger. The resilient member spaces the armature from the latch. A second spring abuts the second surface of the latch.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the tamper resistant electrical receptacle, and are not intended to limit the structure of the tamper resistant electrical receptacle to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
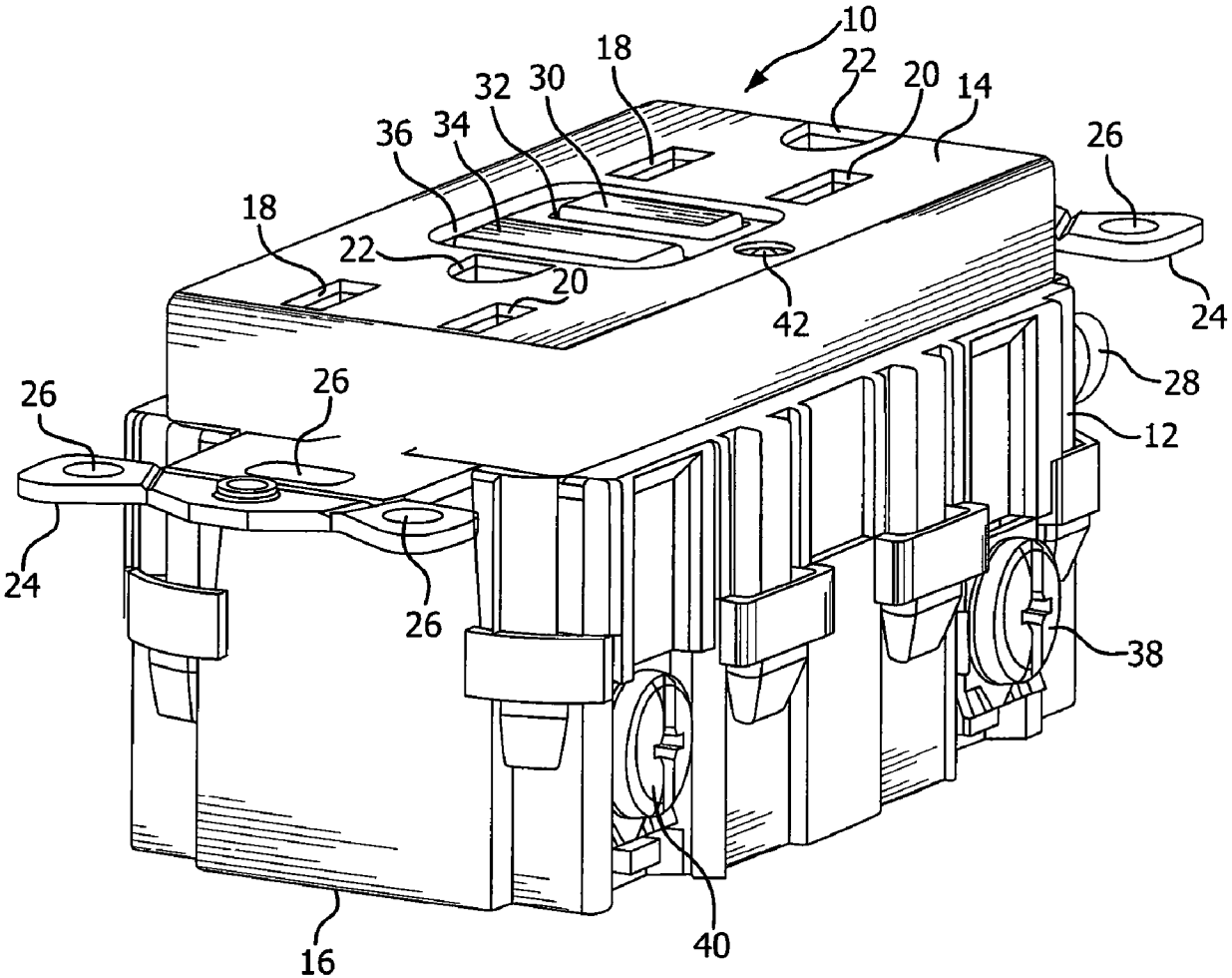
FIG. 1 is a perspective view of an example of a ground fault circuit interrupting (GFCI) device in accordance with an embodiment of the present invention.

As shown in FIGS. 1-5, the present invention includes an impact solenoid assembly for an electrical receptacle 10, for example a fault protection device such as a GFCI. A latch 51 has first and second surfaces 52 and 53, respectively. An armature 61 has first and second ends 62 and 63, respectively.

A plunger 71 abuts the second end 63 of the armature 61. The plunger 71 has a passageway 75 extending from a first end 72 to a second end 73 of the plunger. A resilient member 81 is disposed between the first surface 52 of the latch 51 and the second end 63 of the armature 61 and passes through the passageway 75 in the plunger 71. The resilient member 81 spaces the armature 61 from the latch 51.

FIG. 1 is a perspective view of an example of an electrical receptacle 10 in accordance with an exemplary embodiment of the present invention. The GFCI device 10 includes a housing 12 having a cover portion 14 and a rear portion 16. The GFCI device 10 also includes a barrier portion 15 (FIGS. 2-5) between the cover portion 14 and the rear portion when the cover portion 14 is removed from the rear portion 16. The cover portion 14 and rear portion 16 are removably secured to each other via fastening means such as clips, screws, brackets, tabs and the like. The cover portion 14 includes face receptacles (also known as plug-in slots) 18 and 20 and grounding receptacles 22. It will be appreciated by those skilled in the art that face receptacles 18 and 20 and grounding receptacles 22 may accommodate polarized, non-polarized, grounded or non-grounded blades of a male plug. The male plug may be a two wire or three wire plug without departing from the scope of the present invention. The GFCI device 10 further includes a mounting strap 24 having mounting holes 26 for mounting the GFCI device 10 to a junction box (not shown). At the rear wall of the housing 12 is a grounding screw 28 for connecting a ground conductor (not shown).

A test button 30 extends through opening 32 in the cover portion 14 of the housing 12. The test button 30 is used to activate a test operation that tests the operation of the circuit interrupting portion disposed in the GFCI device 10. The circuit interrupting portion is used to break electrical continuity in one of the conductive paths between the line and load side of the GFCI device 10. A reset button 34 extends through opening 36 in the cover portion 14 of the housing 12. The reset button 34 is used to activate a reset operation, which reestablishes electrical continuity in the open conductive paths.

The rear portion 16 has four screws, only two of which are shown in FIG. 1. Load terminal screw 38 is connected to a neutral conductor and a load terminal screw (not shown, and disposed opposite to the load terminal screw 38) is connected to the hot conductor. A line terminal screw 40 is connected to the neutral conductor and a line terminal screw (not shown, and disposed opposite to the line terminal screw 40) is connected to the hot conductor. It will be appreciated by those skilled in the art that the GFCI receptacle 10 may also include apertures proximate the line and load terminal screws 37, 38, 39 and 40 to receive the bare end of conductors rather than connecting the bare end of the wires to the line and load terminal screws. The GFCI device 10 may also have an alarm indicator 42 for providing an indication to a user that GFCI device 10 is operating normally, the conductive path between the line and load terminals is open, or the GFCI device 10 is operating as a receptacle without fault protection.

Figure 2:
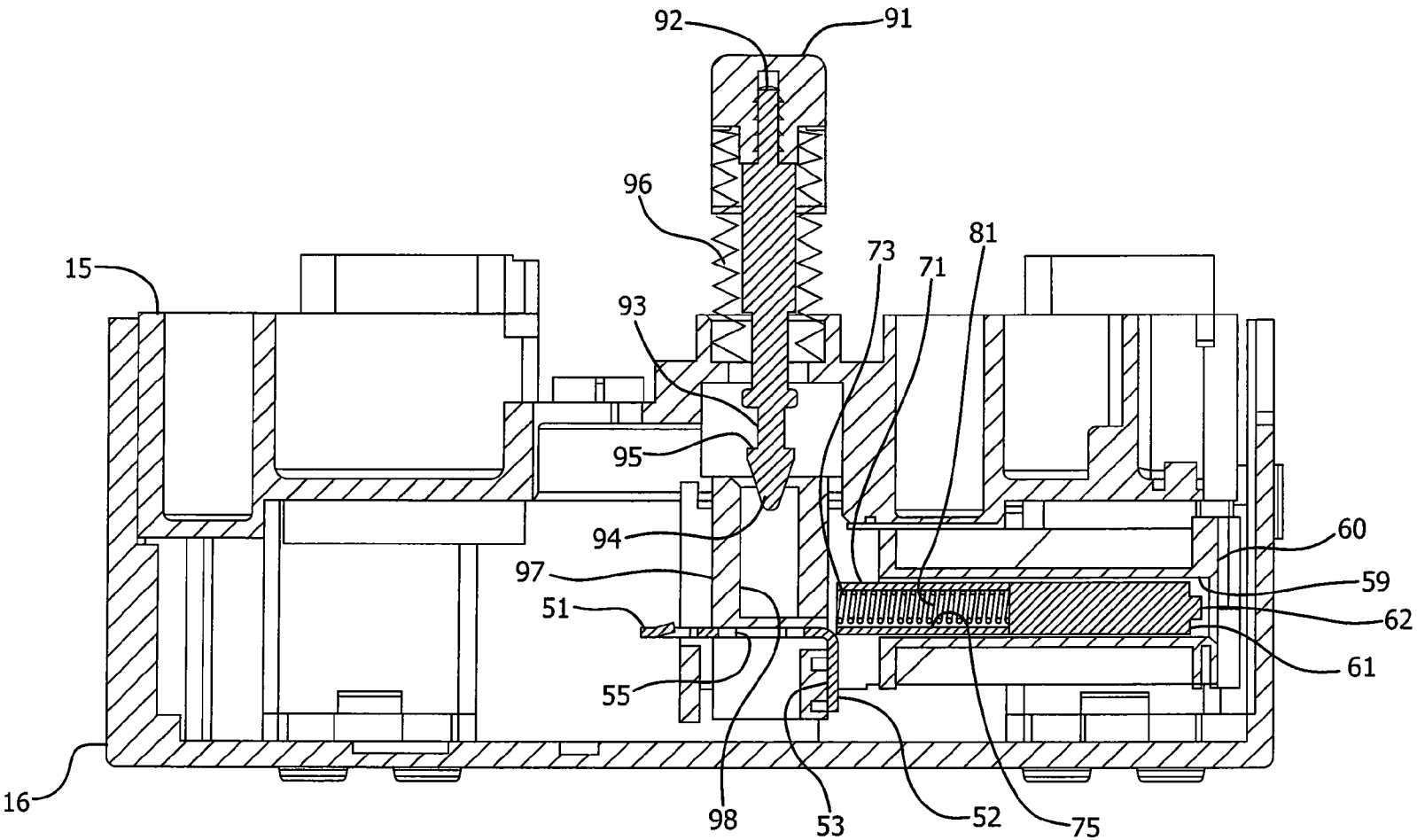
FIG. 2 is an elevational view in cross section of the impact solenoid assembly in which the reset button is an outward position.

An armature 61 is disposed within a solenoid 60, as shown in FIGS. 2-5. The solenoid 60 has an axial bore 59 through which the armature 61 is driven by the solenoid. The armature 61 has a first end 62 proximal a side wall of the rear portion 16 and a second end 63. When the electrical device is under normal operating conditions, a conventional mis-wire plate (not shown) secures the armature 61 in a position in which the first end 62 is proximal a side wall of the rear portion 16, as shown in FIG. 2. The armature 61 is made of a metallic material, such as steel.

A latch member 51 is disposed adjacent the solenoid 60 in the electrical receptacle 10, as shown in FIGS. 2-5. The latch member 51 has a first surface 52 and a second surface 53. Preferably, the latch member 51 is substantially L-shaped having a first leg 57 and a second leg 59. The first leg 57 engages a resilient member 81 and a spring 85. The second leg 58 has an opening 55 that engages a shaft 93 of a reset button 91.

A plunger 71 is disposed in the axial bore 59 of the solenoid 60 between the latch 51 and the armature 61, as shown in FIGS. 2-5. The plunger 71 has a first end 72 proximal the armature 61, and a second end 73 proximal the latch 51. A passageway 75 extends through the plunger 71 from the first end 72 to the second end 73. The plunger 71 is free to move in the axial bore 59 of the solenoid 60. Preferably, the plunger is made of a nonmagnetic material, such as brass.

Figure 3:
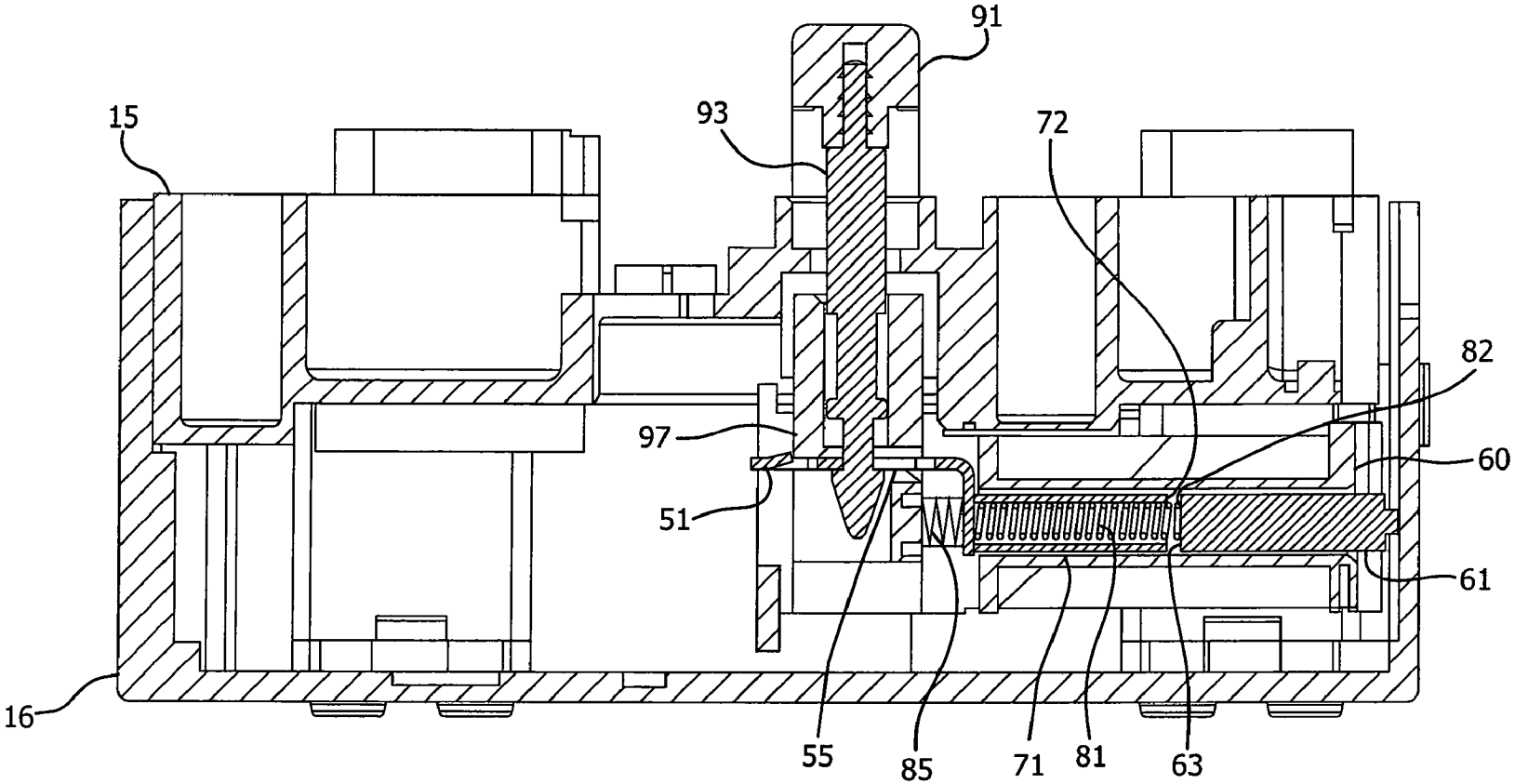
FIG. 3 is an elevational view in cross section of the impact solenoid assembly under normal operating conditions in which a spring biases an armature from a latch.
Figure 4:
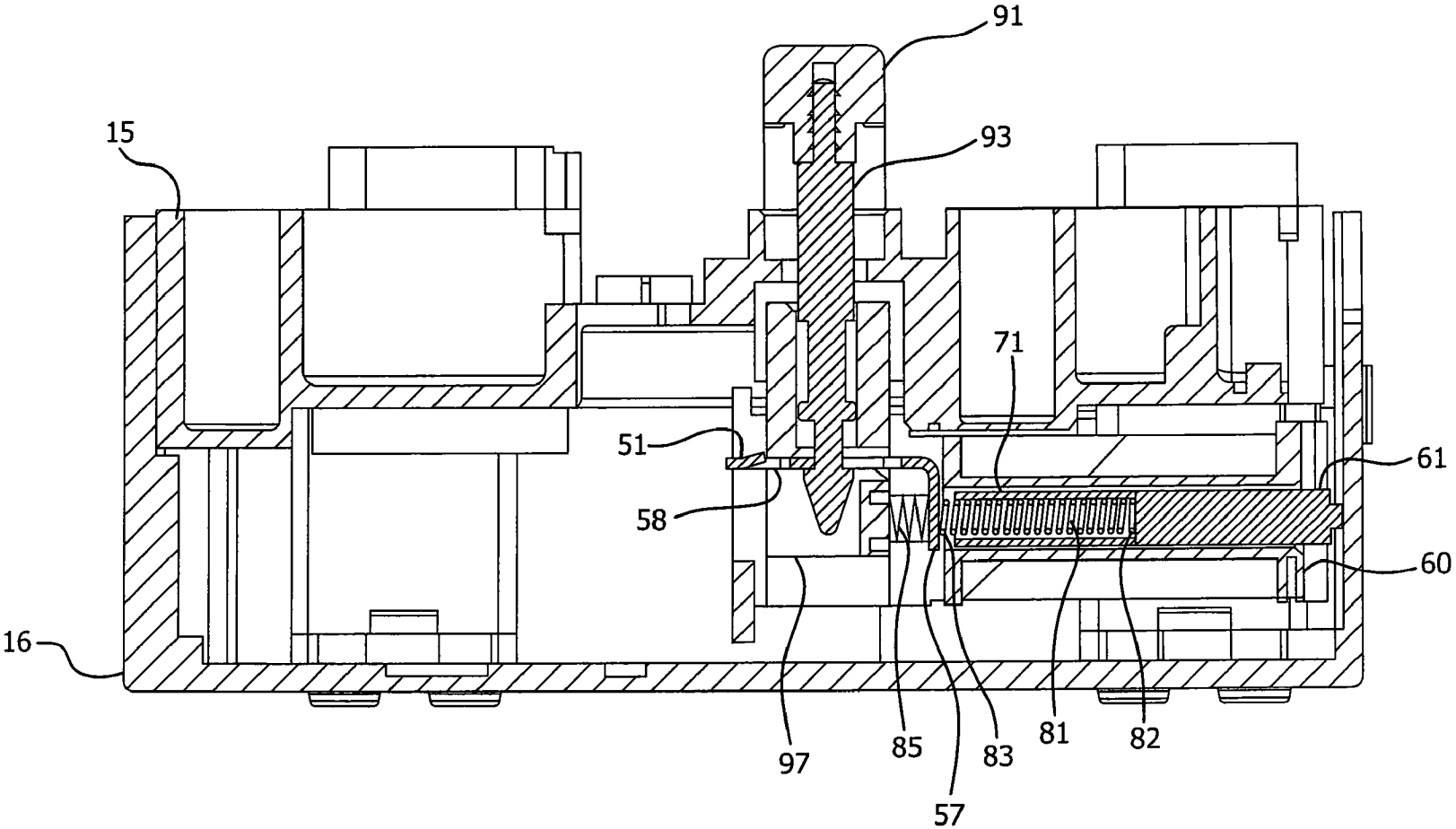
FIG. 4 is an elevational view in cross section of the impact solenoid assembly similar to FIG. 3, but in which the free floating plunger is abutting the armature.

A resilient member 81, such as a helical spring, is disposed between the latch 51 and the armature 61. Preferably, a first end 82 of the resilient member 81 abuts the first surface 52 of the latch 51 and a second end 83 abuts the second end 63 of the armature 61, and the resilient member 81 passes through the passageway 75 in the plunger 71. The resilient member 81 biases the armature 61 from the latch 51 when the electrical device is under normal operating conditions, as shown in FIGS. 3 and 4. Preferably, an air gap is formed between the first end 72 of the plunger 71 and the second end 63 of the armature 61.

Figure 5:
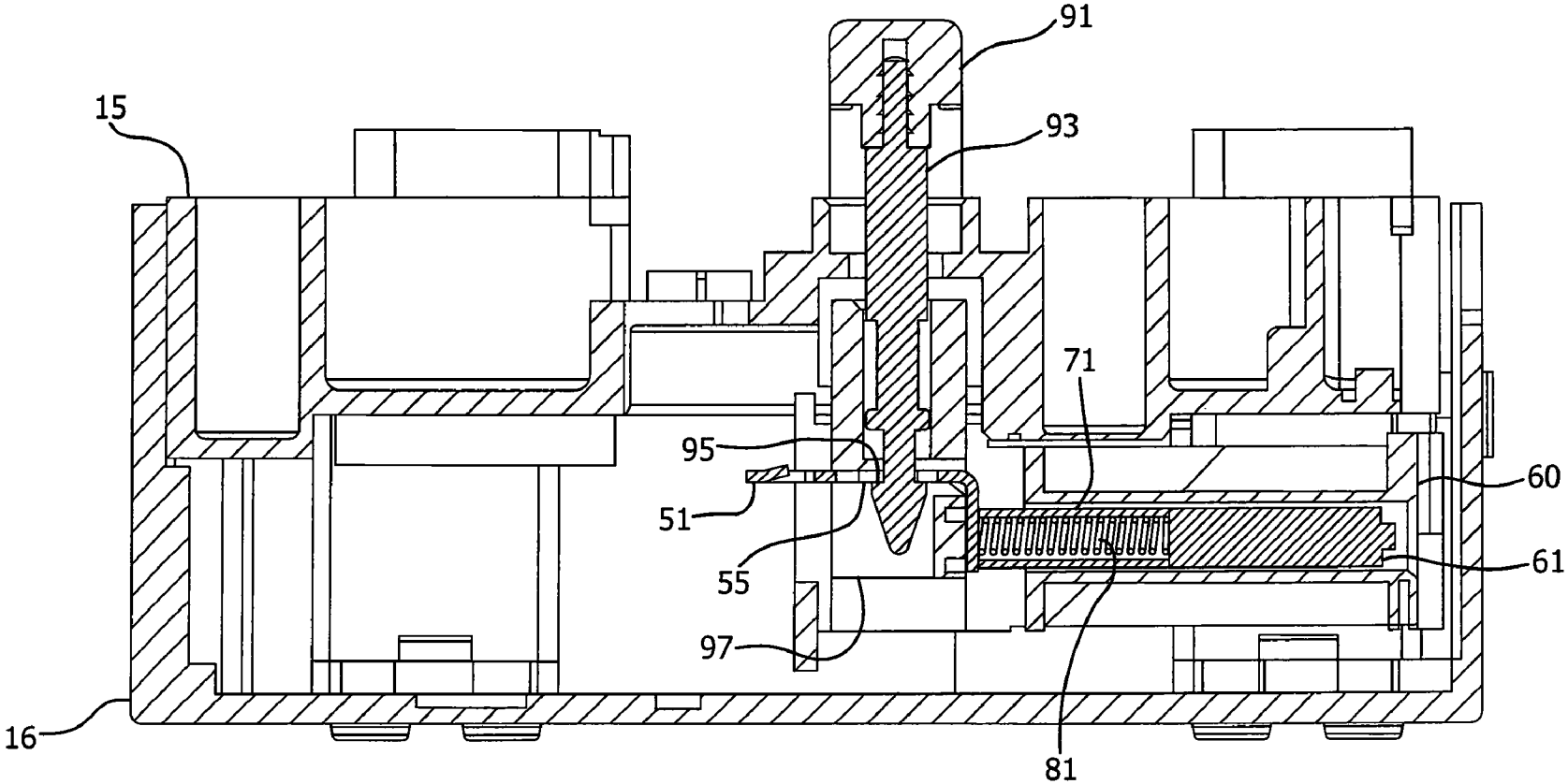
FIG. 5 is an elevational view in cross section of the impact solenoid assembly under a fault condition in which the armature and plunger strike the latch.

A reset button 91 is connected to a second end 92 of a shaft 93. A first end 94 of the shaft 93 is adapted to be releasably connected to the latch 51, as shown in FIGS. 3-5. When the fault protection device detects a fault, the shaft 93 is released from the latch 51, thereby causing the reset button 91 to move outwardly (away from the rear portion 16), as shown in FIG. 2. The first end 94 of the shaft 93 has a shoulder 95 that engages an opening 55 in the latch 51. A spring 96 extends between the reset button 91 and the barrier 15 and is in a compressed condition when the shaft 93 is retained by the latch 51. When the shaft 93 is released from the latch 51 the spring extends and moves the shaft 93 and reset button 91 outwardly.

A spring 85 is disposed between a latch housing 97 and the second surface 53 of the latch 51. The spring constant of the spring 85 is preferably greater than the spring constant of the resilient member 81, thereby biasing the latch 51 toward the plunger 71 and preventing the armature 61 and plunger 71 from moving the latch 51. The shaft 93 is adapted to move axially through a bore 98 in the latch housing 97, as shown in FIGS. 2-5. The latch 51 passes substantially perpendicularly through the bore 98 of the latch housing 97, as shown in FIGS. 2-5, thereby being movably connected to the latch housing.

Assembly and Operation

When the electrical device 10 is initially installed, the reset button 91 is in an outward position, as shown in FIG. 2, due to the biasing force of the spring 96. The movable latch housing 97 and latch 51 are in a position below the plunger 71 and armature 61.

The reset button 91 and shaft 93 are then pushed inwardly (toward the rear portion 16) such that the shoulders 95 of the shaft 93 engage the opening 55 in the latch 51. The spring 96 then causes the shaft 93 to pull the latch housing 97 and the latch 51 upward until the latch housing engages an interior portion of the barrier 15, as shown in FIG. 3. The spring 85, having a greater spring constant than the resilient member 81, biases the latch away from the latch housing 97 toward the plunger 71. The resilient member 81 biases the armature 61 away from the latch 51. Preferably, an air gap is formed between the second end 63 of the armature 61 and the first end 72 of the plunger 71, as shown in FIG. 3. However, the impact solenoid assembly is adapted to be usable in any orientation, such that the plunger 71 is adapted to float freely between the latch 51 and the armature 61. By separating the armature 61 from the latch 51 with the resilient member 81, the electrical device 10 may be installed in any orientation while maintaining a gap between the latch 51 and the armature 61. As shown in FIG. 4, the plunger 71 has floated to a position in which the first end 72 of the plunger is abutting the second end 63 of the armature 61.

When the solenoid 60 is triggered, the solenoid 60 magnetically drives the armature 61 toward the plunger 71. The armature 61 strikes the plunger 71, and both the armature and plunger move toward the latch 51. The armature and plunger strike the second surface 52 of the latch 51, thereby overcoming the spring 85 and moving the latch 51 toward the latch housing 97.

The movement of the latch 51 causes the opening 55 to move to the left, as shown in FIG. 5. Thus, the shoulders 95 of the shaft 93 are released from the latch 51. The spring 96 then causes the shaft 93 and reset button 91 to move outwardly (away from the rear portion 16), as shown in FIG. 2. The reset button 91 may then be reset to return the impact solenoid assembly to an operational status as described above.

Depending on the orientation of the electrical device 10, momentum is created in the armature 61 due to the gap between the armature 61 and the latch 51. The armature 61 and the plunger 71 strike the latch 51, thereby unlocking the latch 51 from the shaft 93 of the reset button 91.

The air gap between the latch 51 and the armature 61 allows the armature 61 to move freely or against a very small resistive force. By allowing the armature 61 to move freely, the armature 61 is able to increase its velocity and create linear momentum, which is the product of mass and velocity. In the absence of the resilient member 81, there would be no air gap between the armature 61 and the latch 51. The value of the velocity of the armature 61 when the solenoid is activated would be zero and there would be no linear momentum created. Thus, by spacing the armature 61 from the latch 51 with a resilient member 81 a more effective and efficient impact solenoid assembly is provided.

While one advantageous embodiment has been chosen to illustrate the invention, it will be understood by those skilled in the art that various changes and modifications may be made therein without departing from the scope of the invention as defined in the appended claims.

What is claimed is:

1. An impact solenoid assembly for an electrical receptacle, comprising:

a latch;

an armature having first and second ends;

a resilient member disposed between said latch and said second end of said armature, a first end of said resilient member abutting said latch and a second end of said resilient member abutting said second end of said armature, said resilient member spacing said armature from said latch; and a plunger disposed between said latch and said armature.

2. An impact solenoid assembly according to claim 1, wherein said resilient member is a helical spring.

3. An impact solenoid assembly according to claim 1, wherein said armature is made of steel.

4. An impact solenoid assembly according to claim 1, wherein said plunger is made of brass.

5. An impact solenoid assembly according to claim 1, wherein said plunger has a first end and a second end, and a passageway extends through the plunger from said first end to said second end.

6. An impact solenoid assembly according to claim 5, wherein said resilient member passes through said passageway in said plunger.

7. An impact solenoid assembly according to claim 1, wherein an air gap is formed between said second end of said armature and a first end of said plunger.

8. An impact solenoid assembly according to claim 1, wherein a shaft connected to a reset button is secured by said latch.

9. An impact solenoid assembly according to claim 8, wherein when said armature is driven by a solenoid, said armature and said plunger move said latch, thereby releasing said shaft to move said reset button outwardly.

10. An impact solenoid assembly for an electrical receptacle, comprising:

a latch having first and second surfaces;

an armature having first and second ends;

a plunger disposed between said latch and said second end of said armature, said plunger having a passageway extending from a first end to a second end of said plunger;

a first spring disposed between said first surface of said latch and said second end of said armature and passing through said passageway in said plunger, said first spring spacing said armature from said latch; and a second spring abutting said second surface of said latch.

11. An impact solenoid assembly according to claim 10, wherein a spring constant of said second spring is greater than a spring constant of said first spring.

12. An impact solenoid assembly according to claim 10, wherein an air gap is formed between said second end of said armature and said first end of said plunger.

13. An impact solenoid assembly according to claim 10, wherein a shaft connected to a reset button is releasably connected to said latch.

14. An impact solenoid assembly according to claim 13, wherein when said armature is driven by a solenoid, said armature and said plunger move said latch thereby releasing said shaft to move said reset button outwardly.

15. An impact solenoid assembly for a fault protection device, comprising:

a solenoid;

a latch having first and second surfaces;

a metallic armature having first and second ends;

a nonmagnetic plunger disposed between said latch and said second end of said armature, said plunger having a passageway extending from a first end to a second end of said plunger;

a first spring disposed between said first surface of said latch and said second end of said armature and passing through said passageway in said plunger, said first spring spacing said armature from said latch;

a second spring abutting said second surface of said latch;

a shaft releasably connected to said latch; and a reset button connected to an end of said shaft, wherein when a fault condition is detected, said armature is driven by said solenoid such that said armature and said plunger strike said first surface of said latch and move said latch, thereby releasing said shaft from said latch to move said reset button outwardly.

16. An impact solenoid assembly according to claim 15, wherein a spring constant of said second spring is greater than a spring constant of said first spring.

17. An impact solenoid assembly according to claim 16, wherein an air gap is formed between said second end of said armature and said first end of said plunger.

18. An impact solenoid assembly according to claim 15, wherein said armature is made of steel.

19. An impact solenoid assembly according to claim 15, wherein said plunger is made of brass.

* * * * *